United States Patent [19]

Kohl et al.

[11] Patent Number: 4,767,286

[45] Date of Patent: Aug. 30, 1988

[54] ICE MACHINE PUMP ASSEMBLY

[75] Inventors: Vance L. Kohl, Manitowoc; John J. Jaschinski, Two Rivers, both of Wis.

[73] Assignee: The Manitowoc Company, Inc., Manitowoc, Wis.

[21] Appl. No.: 57,381

[22] Filed: Jun. 2, 1987

[51] Int. Cl.[4] ..... F04B 17/00

[52] U.S. Cl. ..... 417/423 R; 310/63; 403/360

[58] Field of Search ..... 417/360, 423 H, 423 L, 417/423 P, 423 T, 424 R, 424 A, 372, 368; 310/60 R, 63; 403/360

[56] References Cited

U.S. PATENT DOCUMENTS

| | | | |
|---|---|---|---|
| 10,488 | 1/1854 | White | 403/360 X |
| 2,264,945 | 12/1941 | Le Fevre | 417/423 P |
| 2,613,240 | 10/1952 | Robinson | 310/63 |
| 3,199,774 | 8/1965 | Lowell | 310/63 X |
| 3,229,896 | 1/1966 | Levy | 417/423 H |
| 3,407,739 | 10/1968 | Myers | 417/423 T |
| 3,643,119 | 2/1972 | Lukens | 310/60 |
| 4,557,672 | 12/1985 | Levine | 417/360 |

FOREIGN PATENT DOCUMENTS

| | | | |
|---|---|---|---|
| 505227 | 12/1952 | Belgium | 417/424 |
| 518813 | 2/1931 | Fed. Rep. of Germany | 417/424 |
| 1204047 | 10/1958 | France | 417/423 |

*Primary Examiner*—William E. Tapolcai

*Attorney, Agent, or Firm*—Leydig, Voit & Mayer, Ltd.

[57] ABSTRACT

A pump assembly for use in circulating water from a reservoir to an ice forming mold in an ice making machine, the pump assembly comprising an unvented, unit bearing electric motor having a downwardly extending drive shaft, a pump having a housing with an inlet and an outlet, a fan secured to the drive shaft between the motor and the pump, a support structure interconnecting the pump and the motor, said support structure including a cylindrical upper portion encircling the fan and having an upper edge which is spaced from the bottom of the motor to define an annular slot, said interconnecting structure also including a lower portion with openings near the surface of the water in the reservoir, and a substantially cylindrical collar encircling the motor which defines a substantially axial extension of the annular slot, through which cool air from the surface of the reservoir is directed to the motor to prevent the motor from overheating.

16 Claims, 2 Drawing Sheets

3B
3B
8
8

FIG. 4
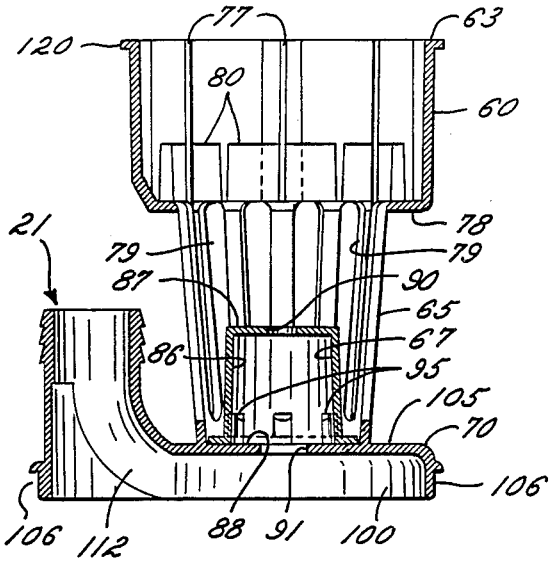
FIG. 5
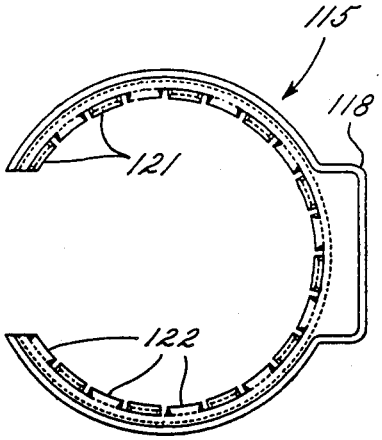
FIG. 6A
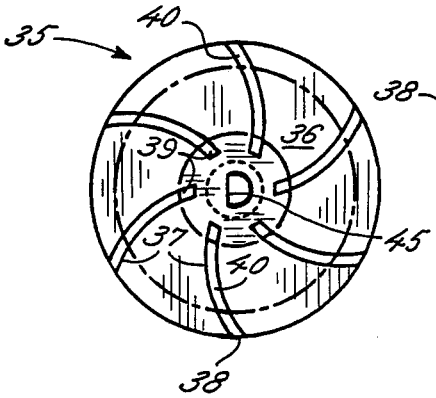
FIG. 6B
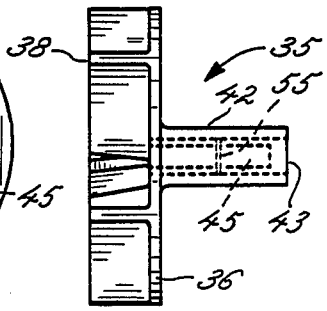
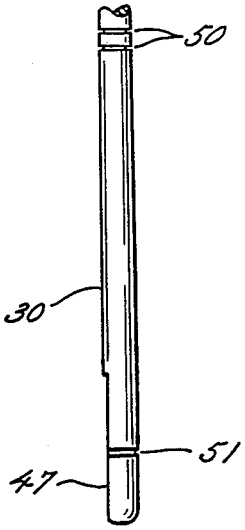
FIG. 7
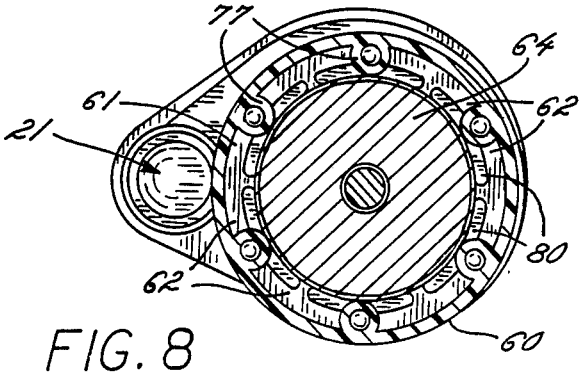
FIG. 8

ICE MACHINE PUMP ASSEMBLY

The present invention relates generally to commercial ice making machines, and more specifically to a motor driven pump for circulating water over the ice-forming mold of such machines.

BACKGROUND OF THE INVENTION

A compression refrigeration ice maker has evaporator coils in close thermal contact with the ice-forming mold. Such ice making machines typically employ a small water circulating pump to circulate water over the mold to build up the desired ice forms. Pumps that are used for this purpose are commonly combined with, and driven by, an electric motor which is vented to prevent the motor from overheating.

In the operation of commercial ice making machines, such as in motels, restaurants and the like, one of the most frequently occurring problems is failure of the electric motor. Conventional motors for ice making machines are particularly susceptible to bearing failure. Such motors are typically selected without regard to the pumping loads, and consequently tend to run hot. This greatly contributes to bearing failure. Venting the motor also contributes to bearing failure, since the circulating water can reach the bearings of the motor through the vents and wash out the lubricant.

The design of the pump itself can also contribute to bearing failure. The housings of currently available pumps often present substantial flow restrictions. Such restrictions compel manufacturers to specify larger motors, which in turn develop more heat. This heat not only diminishes the useful life of the electric motor, but also detracts from the overall efficiency of the ice making machine.

A further deficiency in the design of the standard pump assembly resides in the presence of recesses in areas where water may be splashed or circulated. Such recesses can result in undesirable flow characteristics, and can trap bacteria and fungus, and other harmful organisms.

SUMMARY OF THE INVENTION

The general object of the invention is to provide a new and improved water circulating pump for ice making machines in which a typical cause of bearing failure is avoided by the use of an unvented, single bearing motor. Since such motors tend to run hot, the invention comprehends a new and useful housing which directs cool air around the motor to prevent the motor from overheating.

Another object of the invention is to provide a pump which is more efficient than those of conventional design and which, therefore, permits the use of a smaller motor than might otherwise be required. A related object of the invention is to provide a pump which is designed to impose a minimum drag on the motor.

A further important object is to provide a pump which is both simple and economical to fabricate and assemble. Still another object of the invention is to provide a pump for ice making machines which does not present water-trapping recesses and is easy to clean.

Further objects and advantages of the invention will become apparent upon reading the following detailed description and upon reference to the drawings.

BRIEF DESCRIPTION OF THE DRAWINGS

FIG. 4 is a sectional view of the central structure;

FIG. 5 is a top view of the collar surrounding the electric motor of the pump assembly shown in FIG. 1;

FIG. 6A is a bottom plan view of the impeller;

FIG. 6B is a side view of the impeller illustrated in FIG. 6A;

FIG. 7 is a view of the drive shaft of the pump, as shown in FIG. 2; and FIG. 8 is a sectional view of the fan shroud taken along line 8—8 in FIG. 1.

DESCRIPTION OF THE PREFERRED EMBODIMENT

Figures 1, 2, 3A, 3B:
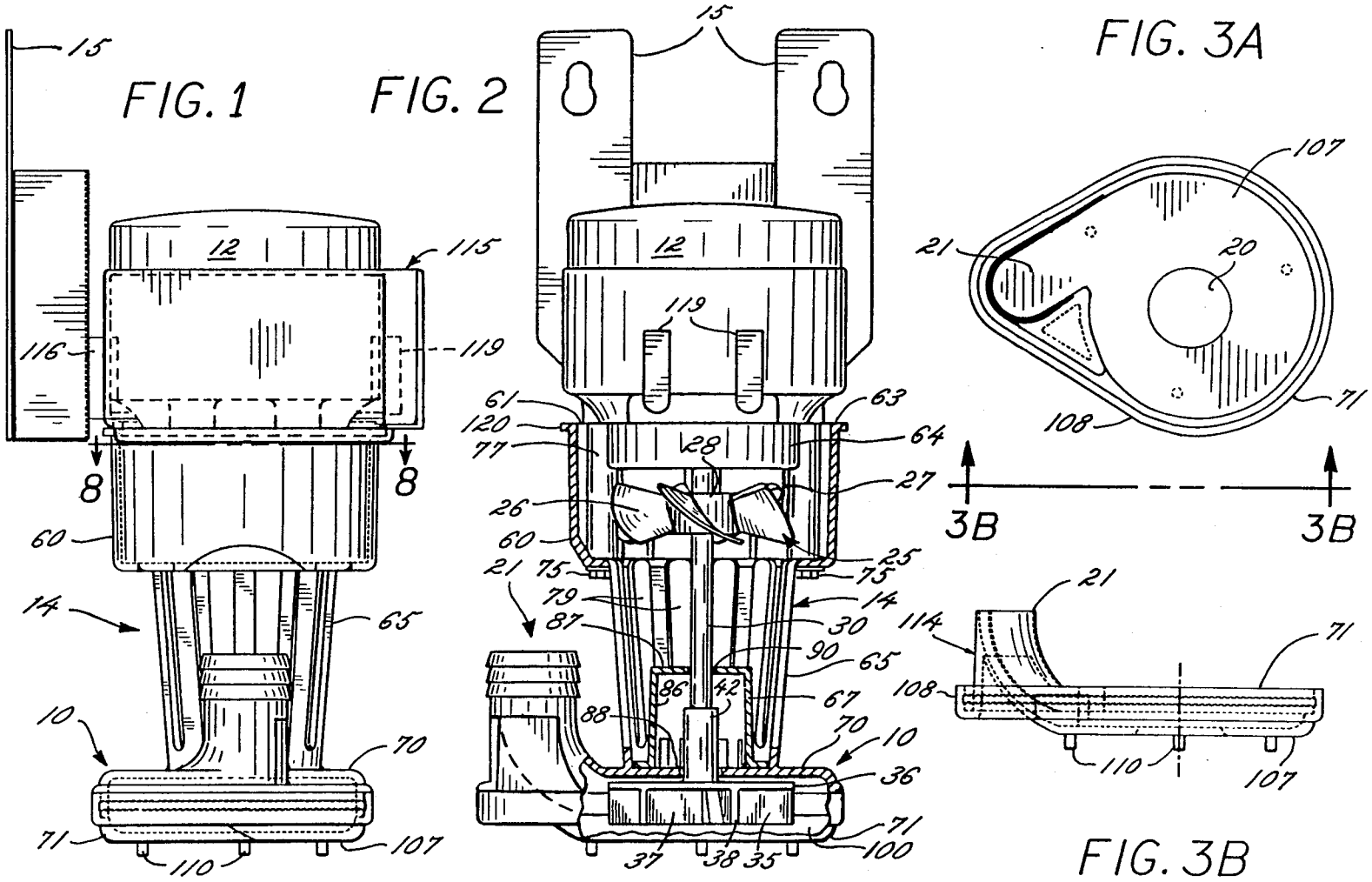
FIG. 1 is a side elevation of a pump assembly for ice making machines constructed in accordance with the present invention.
FIG. 2 is a side elevation of the pump assembly in accord with the present invention, with parts broken away.
FIG. 3A is a plan view of the bottom plate of the pump housing.
FIG. 3B is a side elevation of the bottom plate of the pump housing illustrated in FIG. 3A.

The invention is embodied in a pump assembly for circulating water from a sump or reservoir, through a water circulation system, to the ice-forming mold of a commercial ice making machine. When the pump assembly is used in this way, water is drawn from the sump or reservoir and circulated over the ice forming mold until the desired ice forms are built up. Water that does not adhere to the mold as ice crystals is returned to the sump to be recirculated. To ensure a constant supply of water to the pump, fresh water is added to the sump or reservoir as needed.

While the invention will be described in connection with a preferred embodiment, it will be understood that we do not intend to limit the invention to that embodiment. On the contrary, the invention should be construed to cover all alternatives, modifications and equivalents as may be included in the spirit and scope of the invention as defined by the appended claims.

In general, and referring to FIG. 1, the pump assembly includes a pump housing generally designated by numeral 10, and an electric motor generally designated by numeral 12. The electric motor and the pump housing are interconnected by a central structure generally designated by numeral 14. The pump housing 10 includes an inlet 20 (shown in FIG. 3A) and an outlet 21 which is connected into the water circulation system in a conventional manner. A bracket 15 is provided to support the assembly in the cabinet of the ice making machine.

The electric motor 12 is unvented and includes a single, unitary bearing. Such motors—often called unit bearing motors—are used to power fans, such as those used to blow air over condenser coils, where the flow of air is typically substantial. To prevent the unit bearing motor of the present invention from overheating, cooling is provided by the combination of a collar, which surrounds the motor, a fan, fan shroud, and vented support structure.

The fan is shown in FIG. 2 and is generally designated by numeral 25. Herein, the fan 25 has five arcuately curved blades 26 which are attached to a hub 27 having a central bore 28. The width of each blade increases from the central hub to its outer edge. The hub 27 is mounted on a drive shaft 30 which extends downwardly from the motor 12 through the upper portion of the pump housing 10. The fan is preferably mounted approximately 1 to 3 centimeters below the motor. From this position, the fan provides air circulation around the motor and also serves to deflect any water which may migrate up the drive shaft to the side of the central support structure and, thus, away from the motor and its unitary bearing.

An impeller 35 is disposed within the pump housing 10 and is attached to the end of the drive shaft 30. The impeller 35 is shown separately in FIGS. 6A and 6B. The impeller includes a circular plate 36 having depending fins or vanes 37 therewith which terminate in a substantially straight outer edge 38, coincident with the outer periphery of the plate 36, and an inclined inner edge 39 terminating in a straight bottom edge 40 joining the lower edges of the inner edge 39 and the outer edge 38. The fins or vanes or arcuately curved, and the inner edges 39 are spaced from the center of the plate 36 so that the inner edges 39 are spaced outwardly from the inlet 20.

The mounting structure for the impeller includes a generally cylindrical shank 42 having a central opening or bore 43 therein which frictionally and slidably receives the end of the drive shaft 30. The bore 43 is provided with a transverse, flat area 45, so that the flat area 45 in the bore 43 will engage the flat portion 47 of drive shaft 30.

Both the fan 25 and the impeller 35 are secured to the drive shaft 30 by snap connections. As shown in FIG. 7, the shaft is circumscribed by grooves (50 and 51) which cooperate with snap rings disposed in the bore of the fan 25 and impeller 35, respectively. The fan and impeller are made of a resilient plastic material, and the snap rings are molded as an integral part thereof. An illustrative snap ring is shown as numeral 55 in FIG. 6B. The edges of the grooves 50 and 51 are sharp corners to provide a maximum area to resist the shearing forces on the snap rings. This creates a very rigid and permanent assembly without the use of internal threading, which is difficult to fabricate and creates uncleanable areas which may support the growth of bacteria and other harmful organisms.

The central structure 14 and the pump housing 10 are fabricated in two parts of a plastic material and surround the fan 25, drive shaft 30 and impeller 35. As shown in FIG. 4, the first part includes a fan shroud 60, a vented support structure 65, an impeller spray cap 67, and the upper portion 70 of the pump housing 10. The second part includes the bottom portion 71 of the pump housing 10, as shown in FIGS. 3A and 3B.

The fan shroud 60 is cylindrically shaped and is mounted to the motor in spaced relation thereto to define a narrow, annular slot 61 between the upper edge 63 of the fan shroud and the lower portion 64 of the motor 12. The fan shroud 60 is secured to the motor by machine screws 75, which are enclosed in cylindrical bosses 77. In the preferred embodiment, the cylindrical bosses are spaced at regular intervals around the inside of the shroud and protrude within the annular slot 61 to create a circumferential series of slots 62 between the upper edge 63 of the fan shroud 60 and the lower portion 64 of the motor, as shown in FIG. 8. The cylindrical bosses are provided to prevent fungus and other harmful organisms from becoming trapped in the threads of the screws; they also serve to centrally locate the central structure 14 in relation to the motor so that the central structure can be quickly and easily secured thereto.

The fan shroud 60 has an inwardly extending annular flange 78 on its downward edge, which supports a plurality of upwardly extending projections 80. So that the projections do not trap water which may support the growth of bacteria and fungus, the projections 80 are preferably spaced apart, as shown in FIG. 4, to permit any water which may be confined between the projections 80 and the cylindrical wall of the fan shroud 60 to drain down and out of the central structure 14. In accordance with the invention, the projections 80 encircle the fan and define a nozzle which serves to increase the velocity of the air flowing from the vented support structure 65 to the motor 12.

The vented support structure 65 is an inverted frustrum, and is located between the flange 78 and the upper portion of the pump housing 70. Herein, the vents or openings 79 in the structure are spaced at approximately 30° intervals and permit cool air from near the surface of the circulating water to be drawn into the fan and directed, for cooling purposes, through the series of slots 62 to the upper portion of the motor. Conventional pump assemblies, which have vented motors, do not have such a central, vented support structure in an effort to reduce the incidents of bearing failure.

An impeller spray cap 67 is mounted at the downwardly extending edge of the vented support structure 65 and is attached thereto by a suitable method such as solvent bonding. The spray cap comprises a conically shaped side wall 86 and a flat upper and lower plate 87 and 88, respectively. The drive shaft 30 extends through a central bore 90 and 91 in the upper and lower plates, respectively. As shown in FIG. 2, the shank 42 of the impeller extends upwardly through the bore 91 in the lower plate 88 and is surrounded by the spray cap. Spaces 95 along the lower edge of the conical side wall 86 permit water which has been forced up through the bore 91 to flow out evenly through spaces 95 and vents 79. The spray cap 67 is also designed to contain a quantity of water during the operation of the pump to slow the velocity of any water that may be sprayed upwardly through the central bore 90.

As shown in FIG. 2, the pumping chamber 100 is defined by the upper and lower portions 70 and 71 of the pump housing 10. The upper portion 70 is integral with the vented support structure 65 and includes a generally flat top wall 105 and a shallow, downturned side wall 106. The lower portion 71 of the pump housing includes a substantially flat bottom plate 107 and an upturned flange 108 around the periphery thereof which is slidably and frictionally mated to the downturned sidewall 106 of the upper portion 70 by an appropriate seal, such as a snap type seal having multiple sealing edges. To ensure the smooth flow of water into the pumping chamber, the lower plate is provided with feet 110 on its bottom side to locate the inlet 20 a short distance above the bottom of the sump or reservoir.

The upper portion of the pump housing includes the outlet 21, which is disposed to one side of, and communicates with, the pumping chamber 100. It is important that the outlet 21 present a sweeping radius to minimize drag and reduce turbulence. The upper portion of the outlet is defined by a curved surface 112 molded with the upper portion 70 of the pump housing. The lower portion of the outlet is defined by a curved surface 114 molded with the lower portion 71 of the pump housing. When the upper and lower portions of the pumping chamber are secured together as shown in FIG. 2, the flow from the pumping chamber through the outlet is substantially unrestricted.

As previously disclosed, and in accordance with the invention, the unit bearing motor is cooled by the combination of a collar, which surrounds the motor, a fan, a fan shroud and a vented support structure. The collar is shown generally as numeral 115 in FIG. 1. As shown more clearly in FIG. 5, the collar 115 comprises a cylindrical wall which extends for the major part of a full circle, beginning on one side of mounting tab 116 and terminating on the other side of a second mounting tab (not shown). The mounting tabs are used to attach the motor to the bracket 15. The collar in this instance also includes a projecting portion 118 to accommodate mounting tabs 119 which protrude from the front of the motor.

In the preferred embodiment, the collar is molded in one piece from a suitable plastic and encircles the motor 12 and the upper edge 63 of the fan shroud 60. The collar is concentric with the fan shroud and defines a substantially annular space surrounding the motor, which is, in effect, an axial extension of the circumferential series of slots 62. The collar 115 attaches to a radial lip 120 on the top edge 63 of the fan shroud 60 and is secured thereto by first and second rows of alternating tabs (121 and 122, respectively), which extend inwardly from the lower edge of the collar as shown in FIG. 5. As shown in FIG. 5, tabs 121 extend inwardly further then do tabs 122 to facilitate the assembly process. To assemble the collar 115 to the fan shroud 60, the collar is first placed around the central, vented support structure 65 and then moved upward until the lip 120 is captivated between the two rows of alternating tabs.

With the pump assembly as described above, the pump housing is designed to ensure the unrestricted flow of water through the outlet to minimize drag on the motor, while the fan shroud and collar are designed to ensure a sufficient flow of air to prevent the unvented, unit bearing motor from overheating. Cool air is drawn by the fan 25 from the surface of the reservoir and flows through the central, vented support structure 65, past the fan, to the circumferential series of slots 62, from which the flow of air is directed between the collar 115 and the upper portion of the motor 12. Due to the substantial flow of cool air confined between the collar 115 and the motor 12, the motor is protected from the harmful effects of heat buildup. The absence of vents in the motor also protects the motor's single bearing from water damage, as does the fan and the impeller spray cap. Incidents of bearing failure are thus avoided.

We claim as our invention:

1. A pump assembly for use in circulating water from a reservoir to an ice forming mold in an ice making machine, said pump assembly comprising, in combination: an unvented, unit bearing electric motor having a downwardly extending drive shaft; a substantially cylindrical collar encircling the motor, said collar defining an annular passage alongside the motor; a pump comprising a housing having an inlet and an outlet, and an impeller secured to the drive shaft and disposed within said housing; a fan secured to the drive shaft between the motor and the pump housing; a support structure interconnecting the pump housing and the motor, said support structure including a cylindrical upper portion encircling the fan and having an upper edge which is adjacent the lower edge of the collar and spaced from the bottom of the motor to define an annular slot, said annular slot cooperating with said annular passage to form an air flow channel extending alongside the motor, said support structure further including a lower portion with openings near the surface of the water in the reservoir through which cool air from near the surface of the water is drawn into the support structure, to be directed by the fan through the air flow channel alongside the motor to prevent the motor from overheating.

2. A pump assembly as defined in claim 1 in which the impeller is covered by a spray cap.

3. A pump assembly as defined in claim 1 in which the fan is mounted approximately three centimeters below the motor to deflect any water which may migrate up the drive shaft to the interconnecting support structure, and thus away from the motor.

4. A pump assembly as defined in claim 1 in which the impeller includes a generally cylindrical shank having a central bore therein which frictionally and slidably receives the end of the drive shaft.

5. A pump assembly as defined in claim 4 in which the fan has a central hub and a bore therethrough, wherein the fan and impeller are secured to the drive shaft by resilient, snap connections.

6. The pump assembly as defined in claim 5 in which each snap connection comprises at least one groove which circumscribes the drive shaft and which receives a cooperating ring disposed, respectively, within the bore of the fan and the impeller.

7. A pump assembly as defined in claim 1 in which the outlet of the pump housing comprises a smooth, curved surface to minimize drag and reduce turbulence.

8. A pump assembly as defined in claim 1 in which the upper portion of the support structure is attached to the motor by mounting means which are enclosed in cylindrical bosses.

9. The pump assembly of claim 2 in which the interconnecting support structure, the pump housing and impeller spray cap are made of a plastic and fabricated in first and second parts which are joined by a snap connection.

10. A pump assembly for use in circulating water from a reservoir to an ice forming mold in an ice making machine, said pump assembly comprising, in combination: an unvented, unit bearing electric motor having a downwardly extending drive shaft; a pump comprising a housing having an inlet and an outlet, and an impeller secured to the drive shaft and disposed within said housing; a fan secured to the drive shaft between the motor and the pump housing; a support structure interconnecting the pump housing and the motor, said support structure including a lower portion with openings near the surface of the water in the reservoir, and a cylindrical upper portion encircling the fan and having an upper edge which is spaced from the bottom of the motor to define an annual slot, said upper portion attaching to the motor by mounting means which are enclosed in cylindrical bosses which protrude into the annular slot between the upper edge of said upper portion and the lower portion of the motor to define a circumferential series of slots therein; and a substantially cylindrical collar encircling the motor which defines a substantially axial extension of said annular slot through which cool air from the surface of the reservoir is directed alongside the motor by the fan to prevent the motor from overheating.

11. A pump assembly as defined in claim 10 in which said upper portion has an inwardly extending flange on its downward edge which supports a plurality of projections which encircle the fan.

12. A pump assembly for use in circulating water from a reservoir to an ice forming mold in an ice making machine, said pump assembly comprising, in combination: an unvented, unit bearing electric motor having a downwardly extending drive shaft; a pump comprising a housing having an inlet and an outlet, and an impeller secured to the drive shaft and disposed within said housing; a fan secured to the drive shaft between the motor and the pump housing; a support structure interconnecting the pump housing and the motor, said support structure including a cylindrical upper portion encircling the fan and having an upper edge which is spaced from the bottom of the motor to define an annular slot, and a lower portion with openings near the surface of the water in the reservoir; and a substantially cylindrical collar encircling the motor which defines a substantially axial extension of said annular slot through which cool air from the surface of the reservoir is directed alongside the motor by the fan to prevent the motor from overheating, said collar having first and second rows of mounting tabs which extend inwardly from the lower edge of the collar to attach the collar to the upper edge of the upper portion of the interconnecting structure.

13. The pump assembly as defined in claim 12 in which a lip extends outwardly from the upper edge of said upper portion of the interconnecting structure and is captivated between said first and second rows of tabs.

14. The pump assembly as defined in claim 13 in which the first row of mounting tabs extends inwardly further than the second row of mounting tabs.

15. A pump assembly for use in circulating water from a reservoir to an ice forming mold in an ice making machine, said pump assembly comprising, in combination: an unvented, unit bearing electric motor having a downwardly extending drive shaft; a pump comprising a housing having an upper portion which includes an outlet, and a lower portion which includes an inlet, and an impeller secured to the drive shaft and disposed within said housing; a spray cap covering the impeller; a fan secured to the drive shaft between the motor and the pump housing; a support structure interconnecting the pump housing and the motor, said support structure including a cylindrical upper portion encircling the fan and having an upper edge which is spaced from the bottom of the motor to define an annular slot, and a lower portion with openings near the surface of the water in the reservoir; the interconnecting support structure, the pump housing and impeller spray cap being made of a plastic and fabricated in first and second parts which are joined by a snap connection; and a substantially cylindrical collar encircling the motor which defines a substantially axial extension of said annular slot through which cool air from the surface of the reservoir is directed alongside the motor by the fan to prevent the motor from overheating.

16. The pump assembly of claim 15 in which said first part includes the interconnecting support structure, the impeller spray cap and the upper portion of the pump housing, and said second part includes said lower portion of said pump housing.

* * * * *